United States Patent [19]

Brennecke et al.

[11] 4,411,707

[45] Oct. 25, 1983

[54] PROCESSES FOR MAKING CAN END STOCK FROM ROLL CAST ALUMINUM AND PRODUCT

[75] Inventors: Paul Brennecke; Donald C. McAuliffe, both of Golden, Colo.

[73] Assignee: Coors Container Company, Golden, Colo.

[21] Appl. No.: 243,033

[22] Filed: Mar. 12, 1981

[51] Int. Cl.[3] ..... C22F 1/04

[52] U.S. Cl. ..... 148/2; 148/11.5 A; 148/439; 148/440

[58] Field of Search ..... 148/2, 11.5 A, 32

[56] References Cited

U.S. PATENT DOCUMENTS 3,930,895 1/1976 Moser et al. ..... 148/11.5 A 4,282,044 8/1981 Robertson et al. ..... 148/11.5 A

*Primary Examiner*—R. Dean

*Attorney, Agent, or Firm*—Bruce G. Klaas; Jerry W. Berkstresser

[57] ABSTRACT

An aluminum container scrap alloy is processed by a modified chill roll cast process into a highly formable sheet material suitable for use as a container end stock, by employing at least a 60% cold reduction followed by an anneal for about two hours at a temperature of from about 825° F. to about 900° F., followed by cold reduction to final gauge.

23 Claims, 10 Drawing Figures

PROCESSES FOR MAKING CAN END STOCK FROM ROLL CAST ALUMINUM AND PRODUCT

BACKGROUND OF THE INVENTION

The present invention relates to the preparation of aluminum sheet material suitable for fabrication into can ends. In particular this invention relates to the preparation of can end stock from continuous chill roll cast sheet aluminum, and more particularly to the preparation of a continuous chill roll cast aluminum sheet suitable for subsequent fabrication in to aluminum can end stock.

Currently, the wide spread concern about the future availability of energy with the resultant concentration on energy conservation, particularly in the aluminum industry, has produced several innovations relating the effective utilization of container scrap as a suitable starting material for the subsequent fabrication of new containers, particularly beverage containers. Less energy is required using scrap as a starting material resulting in lower costs if container scrap containing both body stock and can end stock could be successfully used to make materials suitable for fabrication into new can bodies and can ends.

Typically, substantial modification of existing commercial practices used with can body and can end alloys for the preparation of sheet material from either direct cast or continuous casting processes are required before suitable can stock could be obtained from container scrap, and particularly before suitable can end stock can be obtained which incorporates easy opening features. Exemplary of these efforts are the processes disclosed in U.S. Pat. No. 3,787,248 to William C. Setzer, et. al. issued Jan. 22, 1974; U.S. Pat. No. 3,851,787 to William C. Setzer, et. al. issued Dec. 3, 1974; U.S. Pat. No. 3,802,931 to Linton D. Bylund issued Apr. 9, 1974, and the recent inventions of Robertson, et. al., U.S. patent and applications Ser. Nos. 931,041, 931,040 and 931,036 as well as U.S. Pat. No. 4,238,248 of Ivan Gyongyos, et. al. issued Dec. 9, 1980 and U.S. Pat. No. 4,235,646 of Kurt Neufeld, issued Nov. 25, 1980.

The foregoing patents variously disclose direct chill ingot cast and continuous block type casting processes for utilizing the specific compositions which would be encountered in alloys derived from aluminum scrap and in particular aluminum container scrap.

Moser, et. al., U.S. Pat. No. 3,930,895 issued Jan. 6, 1976, in an example of a process for making can body stock from continuous chill roll cast aluminum to improve the deep drawing characteristics of a modified body stock alloy.

U.S. Patent to J. L. Hunter, No. 2,790,216 issued Apr. 30, 1957, to J. L. Hunter discloses a conventional method and apparatus for continuously chill roll casting aluminum alloys which is incorporated herein by reference. The apparatus disclosed produces a chill cast product of sheet metal stock which is generally characterized by a uniform grain microstructure including particles of intermetallic compounds including a compound based on Al-Mn, dispersed throughout the alloy matrix.

It has been desireable to employ the Hunter Apparatus disclosed in U.S. Pat. No. 2,790,216 for the continuous chill roll casting of aluminum alloys. Difficulties are however encountered in producing satisfactory container end stock utilizing alloys derived from container scrap when using the Hunter type of process and apparatus. Can ends utilizing easy opening features, such as ring pull tabs and stay-on tabs for containers which must withstand at least 50 pounds per square inch internal pressure, require special physical properties in order to withstand the severe forming operations that are encountered in the fabrication of the easy opening feature.

It is therefore an objective of the present invention to provide a process for the production of highly formable continuous chill roll cast aluminum sheet stock from aluminum alloy compositions normally encountered in mixed container scrap. This sheet stock must exhibit an ability to be fabricated into can ends having easy open features.

It is a further object of the present invention to provide an aluminum sheet material which is characterized by a particular microstructure in an aluminum alloy which contains between 1.3% to 2.5% by weight magnesium and between 0.4% to 1.0% by weight manganese.

SUMMARY OF THE INVENTION

The present invention comprises a method of producing chill roll continuous cast aluminum alloy sheet material, which method incorporates a relatively high temperature annealing step during the preparation of the sheet material, after an initial cold rolling reduction has occurred.

In the practice of the present invention a conventional chill roll continuous casting apparatus, such as described typically in the aforementioned Hunter patent, is utilized to continuously cast an aluminum alloy sheet material in the conventional manner. The roll cast aluminum alloy is coiled and permitted to cool, generally in still air. Thereafter the as-cast aluminum sheet is cold worked to at least a 60% reduction in gauge and then annealed at a temperature between about 825° F. (440° C.) to 900° F. (483° C.) for a period of time sufficient to develop the improved formability described herein, before cold reduction to the finished gauge and subsequent fabrication into an easy open can end.

For the purpose of description the terms chill roll casting as used herein refers to the process and apparatus disclosed in the aforementioned patent to J. L. Hunter, U.S. Pat. No. 2,790,216 as well as including any kind of apparatus and process where molten metal is fed into the nip formed by two water cooled rotating rollers in a manner which quickly and continuously extracts the heat of fusion of the molten metal and drops the temperature of the metal sufficiently while passing between the rolls to exit a solid continuous slab of product.

DETAILED DESCRIPTION OF THE INVENTION

Figure 1:
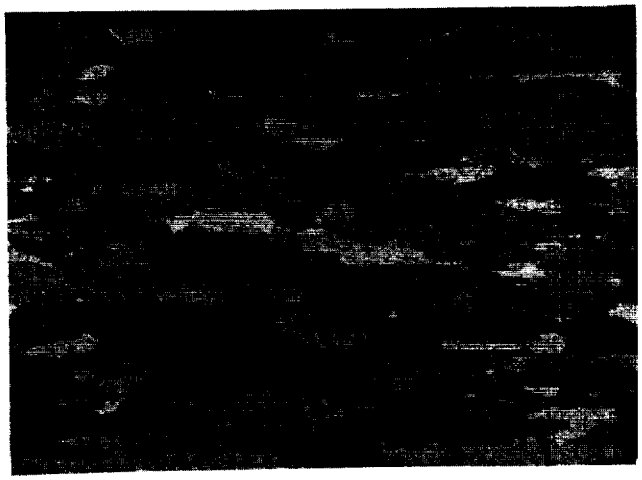
FIG. 1 is a photomicrograph showing the recrystallized grain size at 80 power magnification of a container scrap alloy produced by conventional annealing practice at 670° F. (355° C.).

In the preferred practice of the process of the present invention to produce container end stock, the aluminum alloy used in the chill roll continuous casting apparatus can be obtained from the melting of a prepared alloy of the desired composition or from adjusting the composition of a melt of container scrap. Typically container scrap will contain by weight about 75% of aluminum alloy body stock such as 3004 and 25% by weight of aluminum alloy can end stock such as 5082 or 5182. Typically, the alloy to be used in the process of the present invention should comprise by weight between 1.3% to 2.5% magnesium; 0.4% to 1.0% manganese; 0.1% to 0.9% iron; 0.1% to 1.0% silicon; 0.0% to 0.4% copper; and 0% to 0.2% titanium with the balance being aluminum with other impurities to only trace amounts, which will be less than 0.05% for each constituant, and less than a total of about 0.2% by weight.

It is the presently particularly preferred practice of the present invention to adjust such a composition into a somewhat narrower range of magnesium and manganese which can have the following composition; 1.6% to 2.0% magnesium 0.6% to 0.8% manganese; 0.3% to 0.7% iron; 0.15% to 0.40% silicon; 0.0% to 0.4% copper; and 0% to 0.15% titanium the balance being aluminum with individual impurities in trace amounts less than 0.05% each. Preferably the total amount of impurities should not exceed 0.2%. It is additionally desireable to maintain a ratio of magnesium to manganese in the range of from between 1.4:1 and 4.4:1 wherein the total by weight of magnesium and manganese together in the alloy is in the range from about 2.0% by weight to 3.3% by weight.

Preferably, the molten aluminum alloy within the above-composition ranges is initially chill cast between the water cooled rolls of a chill roll continuous caster to a thickness between about 0.230 inches to about 0.280 inches. The temperature of the aluminum alloy on introduction between the rolls is preferably in the temperature range of from 1260° F. (682° C.) to 1310° F. (710° C.). As the aluminum alloy solidifies between the rolls, there will be a reduction by the force of the rolls of up to about 25%. After the solid aluminum sheet leaves the chill roll continuous caster it is coiled continuously and the coils allowed to cool at room temperature in preferably still air, prior to subsequent cold working as is conventional practice with this type of equipment. The cooled, coiled sheet material is then cold rolled to cold work the metal with at least a 60% reduction in thickness before being annealed in an inert atmosphere at between 825° F. (440° C.) to 900° F. (483° C.), for a sufficient period of time, normally about two hours, for achievement of the grain refinement and reduction in visible dispersoid characteristic of the product produced by the process of the present invention. At the end of the annealing step the sheet stock is allowed to cool and again cold worked, preferably when making container end stock, to at least an 85% reduction in thickness to the final gauge.

It has been discovered that the step of annealing at 825° F. (440° C.) to 900° F. (483° C.) and particularly at 850° F. (455° C.) when compared to the conventional practice of annealing at about 670° F. (355° C.), produces a refinement in subsequently recrystallized grain structure and a product exhibiting an improved formability which more closely approaches that of conventional end stock alloys such as 5082.

Without being held to any specific theory it is presently believed that when a higher annealing temperature is employed, after at least a 60% cold reduction and, in the case of container end stock then followed by at least an 85% cold reduction, it produces the improved formability of the finished material. This appears to be achieved first by the fragmentation of the as-cast microstructure during the initial cold reduction resulting in a large population of high angle grain boundaries which produce more nucleation sites. Secondly, the higher than normal temperature anneal visually reduces the finely dispersed manganese dispersoid in the metal. The latter phenomenon is believed to be responsible for the sheet materials ability to withstand greater plastic deformation when subjected to high forming forces before exhibiting fracture failure. The process therefore produces a product exhibiting finer recrystallized grain structure and a visually cleaner background than is obtained using conventional practice with the same alloy.

Can ends made from sheet stock prepared as described herein exhibited less rivet formation failures than the same alloy produced by employing the conventional annealing practice during the manufacturing process. The yield strength of the sheet metal in thicknesses of about 0.0115" remains above about 40,000 pounds per square inch after the conventional coating bake operation utilized in the production of containers. The end buckle strength at 0.0115" gauge and end configuration remains above 50 pounds per square inch internal pressure, which is the minimum design criteria sought for can end stock utilized in beverage container applications.

Increased buckle strength can also be obtained by utilizing the same material processed as described herein by increasing the gauge of the sheet stock. In addition, for some applications, adjustments in the alloy composition to provide for higher magnesium and manganese concentrations can contribute to increased buckle strength. Likewise the angular bending range over a zero thickness (OT) radius approximates that of 5082 can end stock alloys which are typically in the range of from between 115° to 130°.

The photomicrographs of FIGS. 1–9 are representative of the differences produced by the higher temperature annealing step in the process of the present invention, and were prepared from materials processed according to the following examples. Unless otherwise specified, all components are in weight percent of the final aluminum alloy composition and trace impurities, i.e. less than 0.05% total less than about 0.2%.

In describing the mill practice employed, the percent reduction referred to herein is calculated by subtracting the reduced thickness from the original thickness before the first of any specific reduction, dividing that difference by the original thickness and multiplying by one hundred to obtain the percentage of reduction.

EXAMPLE 1

An aluminum alloy melt of composition:

| Si | Fe | Cu | Mn | Mg | Zn | Ti |
|---|---|---|---|---|---|---|
| .20 | .41 | .01 | .61 | 1.62 | .02 | .02 |

was prepared. The prepared alloy was degassed and fluxed in a molten metal treatment box manufactured by Intalco of Riverside, Calif. The temperature of the melt was adjusted to 1280° F. prior to entry into a Hunter laboratory roll caster manufactured by Hunter Engineering of Riverside, Calif. The casting was performed at a speed of about 24 inches per minute to produce a slab. The cast slab thickness was set to about 0.270". Subsequently the slab was coiled and allowed to air cool to room temperature.

The coil was then cold rolled according to the following mill practice:

One cold roll pass to reduce the thickness from 0.270" to 0.150" and then another cold roll pass to reduce the thickness from 0.150" to 0.100" (a total of a 63% reduction in thickness). The resultant strip was then trimmed to remove any edge cracks or irregularities.

The strip was then annealed for 2 hours at 670° F. (360° C.). Subsequent to annealing the strip was cooled to room temperature and cold rolled to reduce the thickness from 0.100" to 0.075", and then cold rolled to reduce the thickness from 0.075" to 0.040" (a total reduction in thickness of 60%). The strip was then annealed again for 2 hours at 670° F. (360° C.), and cold rolled to reduce the thickness from 0.040" to 0.023", cold rolled to reduce the thickness from 0.023" to 0.016" and finally cold rolled to a finished thickness of 0.0115"±0.0005", for a total reduction in thickness after annealing of 71%.

After the final cold rolling the strip was trimmed, then tension leveled, cleaned and coil coated with Celanese 1174L coating supplied by Jones Dabney of Lexington, KY.

The primary mechanical properties after a conventional coating bake were tensile strength 39,500 psi, yield strength 35,500 psi, and 4.1% elongation.

The prepared aluminum end stock was formed into easy open ring pull ends on production type shell and conversion equipment. Of 2000 ends manufactured approximately 29% were rejected for leakers due to fractured rivets as determined by a Borden leak tester manufactured by Borden Inc. of Randolph, N.Y. Buckle strengths of the formed ends were between 43 and 56 psi.

In addition stay-on-tab type ecology ends were manufactured from this stock on production shell and conversion equipment. Of 2000 ends manufactured approximately 25% were rejected for leakers due to fractured rivets as determined by a Borden tester. Buckle strengths for these ends were between 43 and 53 psi.

Figure 3:
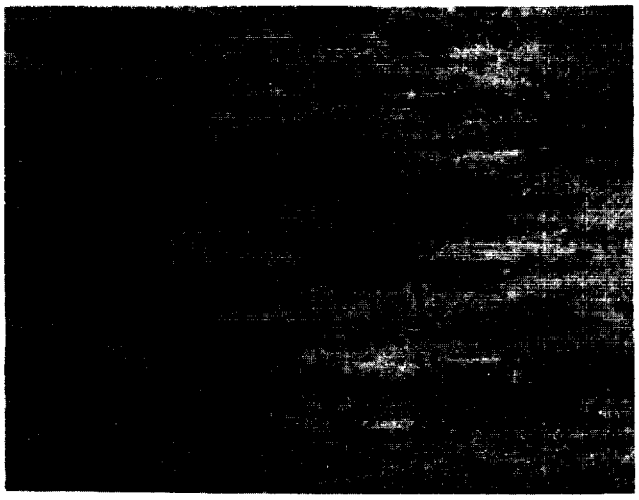
FIG. 3 is a photomicrograph of finished end stock at 10 power magnification, normal to the surface, produced by conventional practice with a container scrap alloy.
Figure 9:
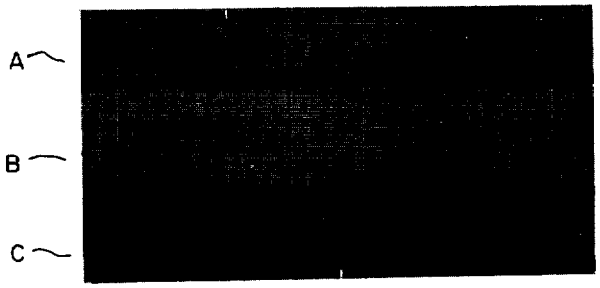
FIG. 9 is a photomicrograph enlarged 50 times comparing the visible background of manganese dispersoid in the product of the process of the present invention with conventional practice and with a conventional 5082 end stock alloy.

FIG. 3 is a photomicrograph of this material at 10 power magnification normal to the sheet surface. The specimen was prepared by conventional macroetching utilizing a §HCl, §$HNO_3$ and §$H_2O$ etch solution. It illustrates a coarse grain fragment structure. In FIG. 9 band C is a photomicrograph of this same material at 50 power magnification in longitudinal cross section. The specimens for this Figure were prepared with a 40 second Keller's etch. Keller's etch is made up of 0.5 cc NaF; 1.0 cc $HNO_3$, 2.0 cc HCl and 97 cc $H_2O$. The dark appearance of the background in the photograph of FIG. 9 illustrates a high volume percent of fine primary dispersoid somewhat uniformly scattered throughout the structure. This structure is believed to deleteriously affect the movement of dislocations long distances during severe forming processes, as evidenced by the high incidence of fractured rivets after container end fabrication.

Figure 6:
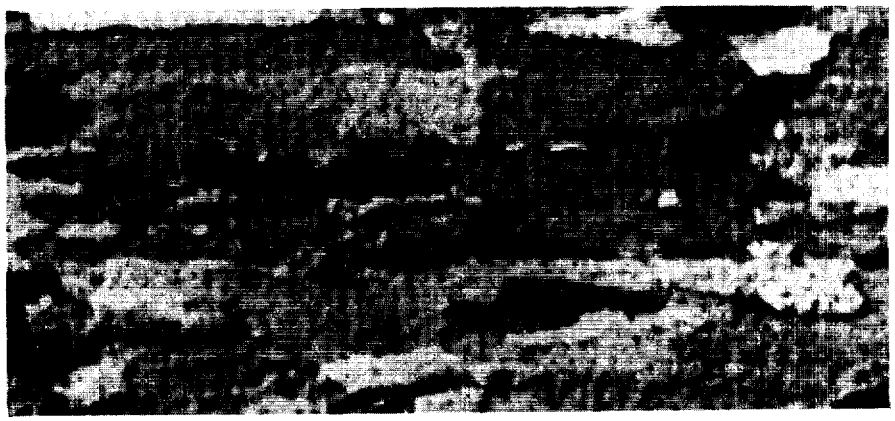
FIG. 6 is a photomicrograph at 280 power magnification of a cross section taken normal to the rolling direction of the alloy shown in FIG. 3.

To further characterize the basic microstructure resulting from the conventional practice used to manufacture this stock a sample of the finish gauge metal was laboratory annealed at 670° F. for one hour to recrystallize its grain structure. To reveal the microstructure the specimen was anodized and photographed at 280 power magnification using polarized light. As shown in FIG. 6, the conventionally produced alloy sheet stock has a grain density of approximately 125 grains per square millimeter. The photomicrograph of FIG. 6 illustrates the recrystallized micrograin size of an alloy produced by conventional practice which produces a small number of recrystallization nucleation sites.

EXAMPLE 2

An aluminum alloy melt of composition:

| Si | Fe | Cu | Mn | Mg | Zn | Ti |
|---|---|---|---|---|---|---|
| .30 | .37 | .02 | .60 | 1.62 | .01 | .02 |

was prepared. The prepared alloy was degassed and fluxed and as in Example 1. The temperature of the melt was adjusted to (1280° F.) prior to entry into a Hunter laboratory roll caster and cast at a speed of about 24 inches per minute. Cast slab thickness was 0.270'. Subsequently, the slab was coiled and allowed to air cool to room temperature.

The coil was cold rolled according to the following fabricating practice:

The coiled strip was cold rolled to reduce the thickness from 0.270" to 0.150". Cold rolled again to reduce the thickness from 0.150" to 0.100" and cold rolled again to reduce the thickness from 0.100" to 0.075", for a total reduction in thickness of 72%. The strip was trimmed as in Example 1 and then annealed for 2 hours at 850° F. in an inert atmosphere furnace.

The strip was then cold rolled to reduce the thickness from 0.075" to 0.050", and cold rolled to reduce the thickness from 0.050" to 0.23" and cold rolled to reduce from 0.030" to 0.023" and cold rolled to reduce from 0.023" to 0.016".

The final cold rolling pass reduced the strip to a final gauge of 0.115" in thickness for an overall reduction after annealing of 85%. The finished strip was cleaned and coil coated with Celanese 1174L coating as in Example 1.

The mechanical properties of the strip or sheet material after bake were tensile strength 42,800 psi, yield strength 39,600 psi, and 3.4% elongation.

Stay-on-tab type ecology ends were manufactured from this stock on production shell and conversion equipment. Of 96,400 ends manufactured none were rejected for leakers due to fractured rivets as determined by a Borden Tester. Buckle strengths for these ends were between 57 and 59 psi.

Figure 4:
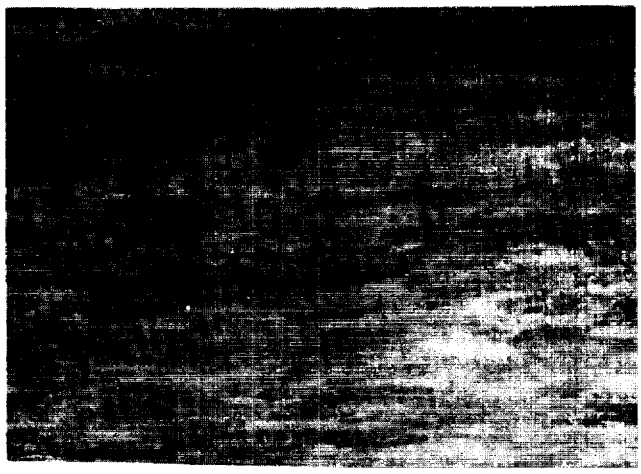
FIG. 4 is a photomicrograph of finished end stock at 10 power magnification, normal to the surface, produced by the practice of the present invention with the same container scrap alloy as in FIG. 3.
Figure 5:
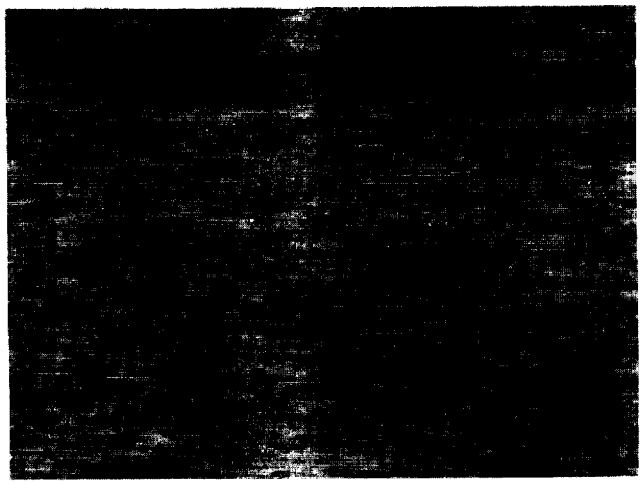
FIG. 5 is a photomicrograph of finished end stock at 10 power magnification, normal to the surface, of a conventional 5082 end stock alloy.

FIG. 4 is a photomicrograph of this material at 10 power magnification normal to the sheet surface. The specimen was prepared by macroetching the same as the material in FIG. 3 from Example 1. It illustrates a finer grain fragment structure than shown in FIG. 3. FIG. 9 band A is a photomicrograph of this same material at 50 power magnification in longitudinal cross section. The specimen for this Figure was prepared with a 40 second Keller's etch. The lighter background appearance of Band A compared to FIG. 9 band C, evidences a lower volume percent of fine visible primary manganese dispersoid and an increased volume percent of coarse dispersoid distributed throughout the structure. This structure is free to permit the movement of dislocations longer distances during severe forming processes.

Figure 7:
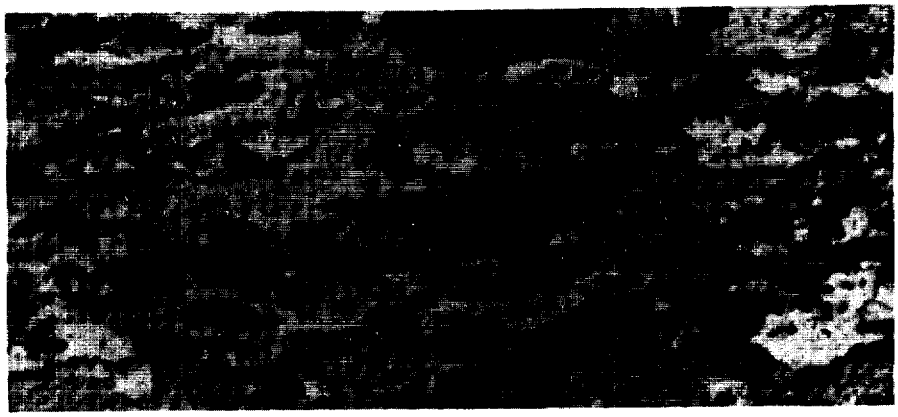
FIG. 7 is a photomicrograph at 280 power magnification of a cross section taken normal to the rolling direction of the alloy shown in FIG. 4.
Figure 8:
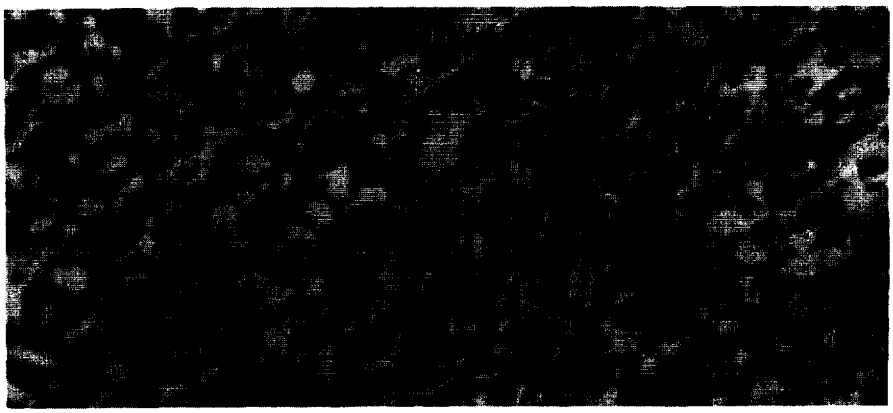
FIG. 8 is a photomicrograph at 280 power magnification of a cross section taken normal to the rolling direction of the alloy shown in FIG. 5.

To further characterize the microstructure resulting from the process of the present invention a sample of the finished gauge material was laboratory annealed at 670° F. for one hour to recrystallize the grain structure. To reveal the microstructure, the specimen was anodized and photographed at 280 power using polarized light as in Example 1. The results of this preparation are shown in FIG. 7 which contains approximately 500 grains per square millimeter. The photomicrograph of FIG. 7 illustrates the recrytallized micrograin size produced by the process of the present invention which is provided by a greater number of recrystallization nucleation sites.

EXAMPLE 3

As in Examples 1 and 2 a composition containing by weight %:

| Si | Fe | Mn | Mg | Zn | Ti |
|---|---|---|---|---|---|
| 0.25% | 0.37% | 0.87% | 1.55% | .02% | .01% |

was formed into a melt and chill roll cast at 1285° F. (696° C.) at an average casting speed of 22.9 inches a minute and a thickness of 0.270 inches.

After coiling and cooling the slab formed, the following mill practice was used on two adjacent samples of the same material:

The first sample was cold worked to a 63% reduction, annealed two hours at 670° F.; cold worked to a 60% reduction and annealed 2 hours at 670° F. The second sample was cold worked to a 63% reduction, annealed 2 hours at 850° F.; cold worked to a 60% reduction and annealed 2 hours at 670° F. Both final anneals used the same heat up rate. A portion of each sample was anodized.

Figure 2:
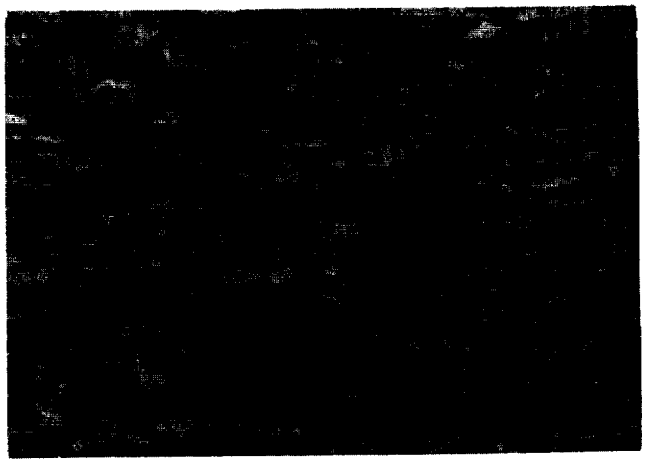
FIG. 2 is a photomicrograph showing the recrystallized grain size at 80 power magnification of the same container scrap alloy as in FIG. 1 produced by the practice of the present invention with an annealing temperature of 850° F. (455° C.).

FIG. 1 and FIG. 2 are 80 power magnification photomicrographs under polarized light of the first and second samples respectively and show the effect on recrystallized grain size of the difference in the intermediate annealing temperatures employed in the two samples. The grain boundaries are highly visible when viewing the anodized surfaces under polarized light so it is visually apparent that the recrystallized grains resulting from the 850° F. intermediate anneal are finer per unit area than the first sample.

EXAMPLE 4

A sample of conventional commercial ingot case aluminum can end alloy 5082, as supplied by a qualified supplier of coated end stock for fabrication into easy open can ends, was annealed at 670° C. for observation of the recrystallized grain structure, etched and the resultant microstructure photographed at 50 power magnification. This is shown in FIG. 9 band B and in FIG. 10 band B for purposes of comparison with first the conventionally prepared sheet material starting from container scrap alloys described in Example 3; FIG. 9, band C, and the sheet material prepared as described in Example 2; FIG. 9 band A.

Figure 10:
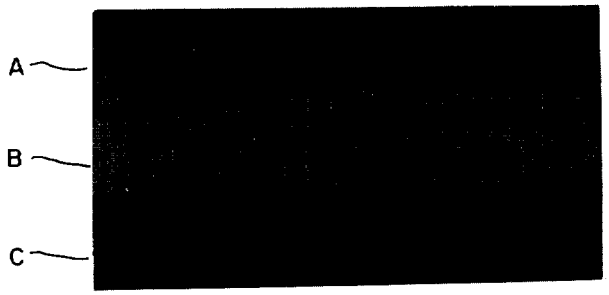
FIG. 10 is a photomicrograph enlarged 50 times comparing the visible background of manganese dispersoid in the product of the process of the present invention with conventional practice and with a conventional 5082 end stock alloy.

The alloy composition of Example 3, second sample, is shown in FIG. 10, band A, while another alloy composition comprising 0.80% Mn and 1.60% Mg with a 670° F. intermediate anneal and a 71% final cold work is shown for comparison in FIG. 10 band C.

It can be seen from the foregoing examples and photomicrographs that a considerably different microstructure is obtained with identical container scrap alloys when one is conventionally processed and the other is processed according to the present invention. Surprisingly, grain refinement occurs with the higher temperature annealing employed with the alloys derived from container scrap. The formability of the differently processed materials is also substantially different particularly in the severe forming operations normally associated with the fabrication of easy opening ends and particularly the formation or rivets in the end. As indicated previously, the observation of recrystallized grain size, as well as the distribution and density of the grains is achieved by annealing the sheet material to recrystallize the grain structure and then etching or anodizing the material and photographing under magnification with polarized or other light.

Observed in the above manner, as described in the examples, it is believed that the advantages of the present invention can only be achieved where after recrystallization at least about 200 grains per square millimeter are observable in the finally reduced sheet stock and preferably there should be at least about 500 grains per square millimeter. The properties observed in such materials compares favorably with conventional commercial 5082 can end sheet stock that exhibits over 1500 grains per square millimeter. Sheet stock produced from the same container scrap alloy processed with a lower temperature anneal exhibits about 125 grains per square millimeter.

A correlation may therefore be drawn between grain size, dispersoid density and the achievement of the improved properties of its product of the disclosed process.

Likewise, the reduction in visible fine dispersoid achieved is believed to improve the sheet materials exhibited resistance to fracture during sever forming operations. This has not hitherto been achieved utilizing conventional chill roll casting practice with alloys derived from container scrap.

The exact limits of functionality are imprecise when related to recrystallized grain microstructure however, it is believed at the present time that at least 200 grains per square millimeter must be obtained to achieve the characteristic improvement in formability.

The disclosed invention can therefore reside in different process conditions than those precisely described as long as there is an achievement of the requisite observable change in microstructure to functionally provide for better can end fabrication.

For example higher annealing temperatures and shorter times, or lower temperatures and longer times preceded and followed by different combinations of cold reductions may produce a product that may functionally be the equivalent of the product of the present process for some purposes.

It has been determined that alloys in the compositions range described hereinbefore can be chill roll cast at temperatures between about 1260° F. (682° C.) and about 1310° F. (710° C.) at casting speeds of from about 18 to 40 inches a minute. Preferably, the range of from about 1271° F. (688° C.) to about 1289° F. (700° C.) and casting speeds of about 20 to 25 inches per minute are utilized.

It should be apparent therefore that the scope of the present invention is only limited by the scope of the attached claims taking into account the description contained herein and equivalents thereof.

What is claimed is:

1. A process for producing an aluminum alloy sheet stock comprising between about 0.4% to about 1% by weight of Manganese and containing an aluminum manganese dispersoid having a size and distribution to render the stock suitable for forming into can ends and can bodies comprising the steps of:

continuously chill roll casting aluminum alloy containing aluminum and manganese at a predetermined slab thickness;

reducing the thickness of the slab by at least 60% to form an aluminum strip; and then annealing the strip at a temperature of about 825° to about 900° F.

2. The process of claim 1 wherein the cast aluminum slab comprises 1.0% between 1.3% and 2.5% by weight magnesium.

3. A process for producing sheet aluminum from a chill roll cast aluminum alloy containing between about 0.4% to 1.0% by weight manganese, which is suitable for use as container end stock, comprising the steps of cold rolling chill roll cast aluminum containing an aluminum manganese dispersoid, to at least a 60% reduction, annealing said material at a temperature in the range of from about 825° F. (440° C.) to about 900° F. (483° C.) for a sufficient period of time for reduction of the visible manganese dispersoid and for the development after final processing and recrystallization of at least 200 grains per square millimeter of microstructure.

4. The process of claim 3 wherein about 500 grains per square millimeter of microstructure are developed.

5. The process of claim 3 or 4 wherein the composition of the chill roll cast aluminum sheet material comprises between 1.3% and 2.5% by weight of magnesium.

6. The process of claim 5 wherein said cold rolling provides at least a 70% reduction in the thickness of the chill roll cast aluminum sheet material.

7. The process of claim 6 wherein the step of annealing said cold rolled material is conducted at a temperature of about 850° F. (455° C.).

8. The process of claim 7 wherein the step of annealing said cold rolled material includes up to two hours of annealing at a temperature of about 850° F. (455° C.).

9. The process of claim 8 wherein the step of annealing includes heating said cold rolled material in a substantially non-oxidizing atmosphere.

10. A process for chill roll casting sheet aluminum from container scrap, comprising the steps of forming a melt of aluminum alloy containing between about 0.4% to about 1.0% by weight manganese; chill roll casting said melt into a slab; cold rolling the slab to a sheet with at least a 60% reduction in thickness; annealing the cold rolled sheet at a temperature in the range of from about 825° F. (440° C.) to about 900° F. (483° C.) for a sufficient period of time for reduction of the visible manganese dispersoid and for the development after final processing and recrystallization of at least 200 grains per square millimeter of microstructure; and cold rolling the annealed sheet to a finished gauge.

11. A process of claim 10 wherein the melt comprises an aluminum alloy having between about 1.3% and 2.5% by weight of magnesium.

12. The process of claim 11 wherein the initial cold rolling is to at least a 70% reduction in thickness.

13. The process of claim 11 wherein the step of cold rolling the annealed sheet is to a reduction in thickness of at least 85%.

14. The process of claim 13 wherein the annealing step is carried out at a temperature of about 850° F. (455° C.).

15. The process of claim 14 wherein the annealing is carried out for about two hours.

16. The process of claim 15 wherein the composition of the aluminum alloy melt comprises magnesium and manganese with a ratio of magnesium to manganese being in the range of from 1.4 to 1 to 4.4 to 1 and the total weight percent of manganese and magnesium together being in the range of about 2.0% to 3.3% by weight.

17. An aluminum sheet material produced from a continuous chill roll casting process wherein said sheet material has been cold rolled to a reduction of at least 60% and annealed at a temperature of from between 825° F. to 900° F., comprising an aluminum alloy exhibiting a recrystallized grain structure having at least 200 grains per square millimeter and containing 0.4% to 1.0% by weight manganese and from 1.3% to 2.5% by weight magnesium.

18. The sheet material of claim 17 wherein the recrystallized grain structure is at least about 500 grains per square millimeter.

19. The sheet material of claim 18 wherein the cold reduction was at least 70%.

20. An aluminum sheet material containing from 0.4% to 1.0% by weight manganese and between 1.3% to 2.5% by weight magnesium prepared by chill roll casting wherein the process includes an initial cold reduction of the sheet to at least 60% and is followed by an anneal at a temperature of from between 825° F. (440° C.) and 900° F. (483° C.) for a sufficient time to produce a recrystallized grain structure containing at least 200 grains per square millimeter.

21. The aluminum sheet material of claim 20 wherein the recrystallized grain structure contains at least 500 grains per square millimeter.

22. The aluminum sheet material of claim 20 wherein the step of annealing is for a time of about 2 hours.

23. The aluminum sheet material of claim 22 wherein the annealing is carried out at a temperature of about 850° F. (455° C.).

* * * * *